United States Patent [19]

Yamamoto et al.

[11] 4,027,581

[45] June 7, 1977

[54] VENTILATOR

[75] Inventors: Yukio Yamamoto, Kurobe; Yukio Sado, Shimoniikawa, both of Japan

[73] Assignee: Yoshida Kogyo Kabushiki Kaisha, Tokyo, Japan

[22] Filed: Apr. 16, 1975

[21] Appl. No.: 568,709

[30] Foreign Application Priority Data

Apr. 25, 1974 Japan ..... 49-47316[U]
Apr. 25, 1974 Japan ..... 49-47317[U]

[52] U.S. Cl. ..... 98/98; 55/496; 98/37

[51] Int. Cl.[2] ..... F24F 13/18

[58] Field of Search ..... 98/37, 97, 98, 99, 99.6, 98/88 R, 96, 114, 2.11, 13, 94, 88 S, 99.2; 55/496, 495, 492

[56] References Cited

UNITED STATES PATENTS

| | | | |
|---|---|---|---|
| 2,205,123 | 6/1940 | Metzgar et al. | 98/99 R |
| 2,561,928 | 7/1951 | Johnston | 98/99 R |
| 2,751,839 | 6/1956 | Moore | 98/96 |
| 3,111,489 | 11/1963 | Getzin | 55/495 X |
| 3,274,759 | 9/1966 | Bell, Jr. | 55/496 |
| 3,464,401 | 9/1969 | McGrath | 126/113 |

*Primary Examiner*—William E. Wayner
*Attorney, Agent, or Firm*—Hill, Gross, Simpson, Van Santen, Steadman, Chiara & Simpson

[57] ABSTRACT

There is disclosed a ventilator for use with windows, doors, or other building hardware. The ventilator includes an inner plate having air vents and an outer plate spaced apart from the inner plate in the transverse direction of the ventilator and providing an opening displaced from the air vents. Provided between the inner and outer plates are a filter and a partition extending from the inner plate toward the outer plate until it abuts against the filter. The partition is adapted to direct a flow of air from the opening to the air vents at least twice through the filter. The ventilator is prefabricated as a unit and is easily installed within the windows, doors and the like.

10 Claims, 5 Drawing Figures

VENTILATOR

BACKGROUND OF THE INVENTION

1. Field of the Invention

This invention relates to ventilators and more particularly to a ventilator for use with window assemblies, doors or other building hardware.

2. Prior Art

There have heretofore been known various kinds of ventilators of the type described. However, these ventilators permit stormy wind or rain of high velocity to enter directly into the interior of a building in which they are installed, because a screen is provided merely on the exterior side of the air vent to prevent the admission of dust carried by wind into the building interior. Furthermore, the prior art ventilators are not effective to completely remove the dust from the flow of air which is directed only once through the filter screen of the ventilator.

SUMMARY OF THE INVENTION

It is the primary object of this invention to provide a ventilator for use with windows, doors and the like that prevents wind of high velocity from entering directly into the building interior.

It is another object of the invention to provide a ventilator which further prevents rain accompanied by winds of substantial velocity to enter the building interior through the ventilator.

A further object of this invention is the provision of a ventilator so constructed as to direct an air flow at least twice through a given filter, thereby substantially removing dust completely from the air within the ventilator.

A still further object of the invention is to provide a ventilator which can be prefabricated in a single unit to facilitate its installation in windows, doors and the like.

Other objects and advantages of the invention will become more apparent from the following description when read in conjunction with the accompanying drawings in which like reference numerals denote like parts through several views.

DESCRIPTION OF THE PREFERRED EMBODIMENT

Figure 1:
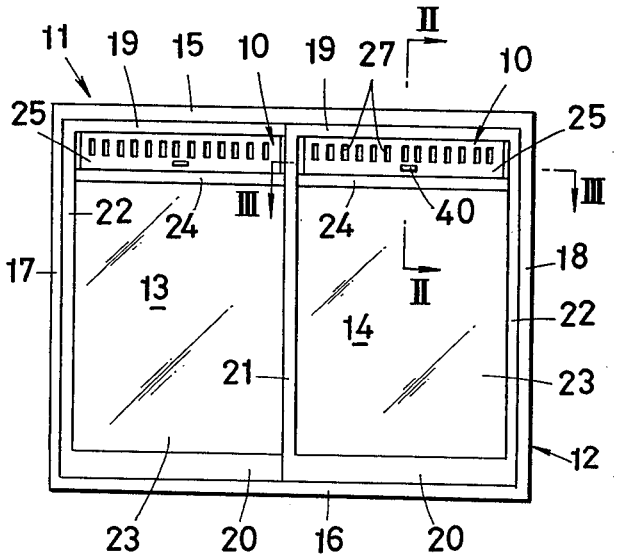
FIG. 1 is an elevational view of a ventilator embodying the invention which is attached to a window assembly of the horizontally movable type and shown as viewed from the interior of a building.

As shown in FIG. 1 a pair of ventilators 10 constructed in accordance with the invention are shown applied to a window assembly 11 of the horizontal sliding or rolling type that generally comprises a fixed frame 12 and a pair of relatively movable sashes 13 and 14 mounted within the fixed frame 12 in parallel, closely spaced planes. As is conventional in the art, the fixed frame 12 comprises a header 15, a sill 16 and a pair of side jambs 17 and 18. The sashes 13 and 14 are each provided with a pair of upper and lower rails 19 and 20, a pair of stiles 21 and 22, and a window glass pane 23. At the upper portion of each sash there is an additional rail 24 which is spaced downwardly from and parallel to the upper rail 19 and fixedly connected at both ends to the stiles 21 and 22. Interposed between the upper rail 19 and the additional rail 24 is the ventilator 10 of which structural details are hereinafter described.

Figure 2:
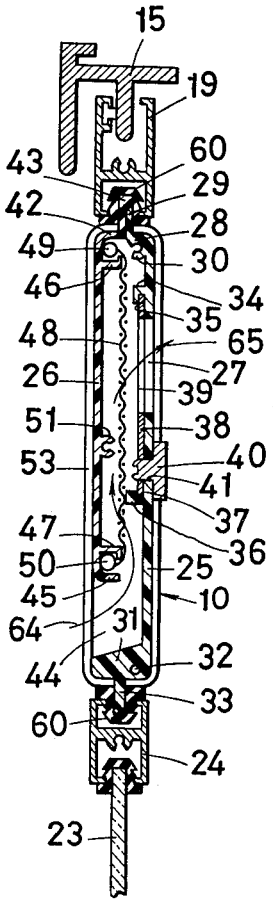
FIG. 2 is a vertical cross-sectional view taken along the line II—II of FIG. 1.
Figure 3:
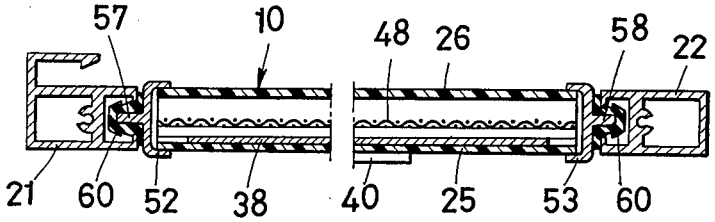
FIG. 3 is a horizontal cross-sectional view taken along the line III—III of FIG. 1.
Figure 4:
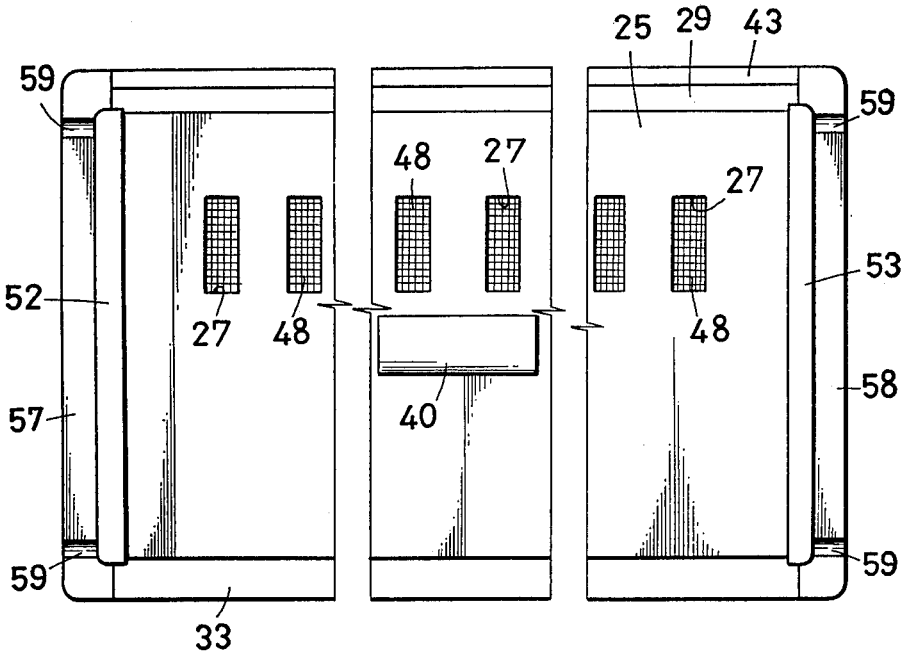
FIG. 4 is an enlarged fragmentary elevational view of the ventilator.

As shown in FIGS. 2 and 3, the ventilator 10 includes an inner plate 25 and an outer plate 26 which are preferably made of a plastic material and are spaced apart a predetermined distance from each other in the transverse direction of the ventilator 10 to provide a hollow interior therebetween. The inner plate 25 is provided at its upper portion with a plurality of longitudinally spaced-apart air vents 27 (FIGS. 1 and 4). The upper end of the inner plate 25 has a flange 28 extending outwardly at substantially a right angle to the inner plate 25 and a mounting fin 29 extending upwardly from the outer end of the flange 28 substantially parallel to the inner plate 25. Provided immediately beneath the flange 28 is a socket 30 for receiving therein a screw (not shown) to assemble the ventilator 10 in a manner explained below. The inner plate 25 is provided at its lower end with a flange 31 extending outwardly therefrom. The upper surface of the flange 31 is slanted downwardly from the inner plate 25 toward the frontal edge of the flange 31. A hole 32 is formed in the flange 31 for receiving therein another assembly screw (not shown). A central mounting fin 33 projects downwardly from the bottom of the flange 31 substantially parallel to the inner plate 25. Projecting outwardly from the inner plate 25 and immediately above the air vents 27 is a flange 34 of an inverted L-shaped configuration which together with the plate 25 defines a downwardly opening groove 35. An L-shaped partition 36 also projects outwardly from the inner plate 25 and is located below the air vents 27. It further extends outwardly toward the outer plate 26 to an extent described below. The L-shaped partition 36 cooperates with the plate 25 in defining an upwardly opening groove 37. Slidably mounted in the grooves 35 and 37 is an elongated adjustment plate 38 which has at its upper region a plurality of slits 39 formed in registration with the air vents 27 in the inner plates 25. A handle 40 passes loosely through an oblong hole 41 in the inner plate 25 and fixely attached to a lower portion of the adjustment plate 38. The handle 40 is adapted to slide the adjustment plate 38 horizontally so as to control the degree of opening of the air vents 27.

The outer plate 26 has at its upper edge an inwardly directed flange 42 extending at substantially a right angle to the plate 26 and an inverted L-shaped mounting fin 43 extending upwardly parallel to the outer plate 26. The inverted L-shaped mounting fin 43 mates complementarily with the mounting fin 29 of the inner plate 25. The lower end of the outer plate 26 terminates above the flange 31 of the inner plate 25, leaving an opening 44 therebetween, and extends inwardly at substantially a right angle to the plate 26 to provide a flange 45. Importantly, the opening 44 is displaced out of registration with the air vents 27 in the inner plate 25, so that the opening 44 faces the inner plate 25 below the L-shaped flange 36.

Former immediately below the flange 42 and above the flange 45 are a pair of flanges 46 and 47, respectively, extending inwardly from the outer plate 26, The flange 47 is spaced downwardly from the L-shaped flange 36 by a distance required to guide unobstructedly the flow of air. As shown in FIG. 2, a filter 48, which is constructed of a screen, a sheet of porous material or any other suitable material, extends between the flanges 46 and 47. To maintain the filter 48 in the proper position, a pair of retainers 49 and 50 are provided between the flanges 42 and 46 and between the flanges 45 and 47, respectively, for frictional engagement with the upper and lower ends of the filter 48. The L-shaped partition 36 extends outwardly toward the outer plate 26 until it abuts against the filter 48 for the reasons described below. Designated at numeral 51 is a socket adapted to receive a screw (not shown) for the assemblage of the ventilator 10.

Figure 5:
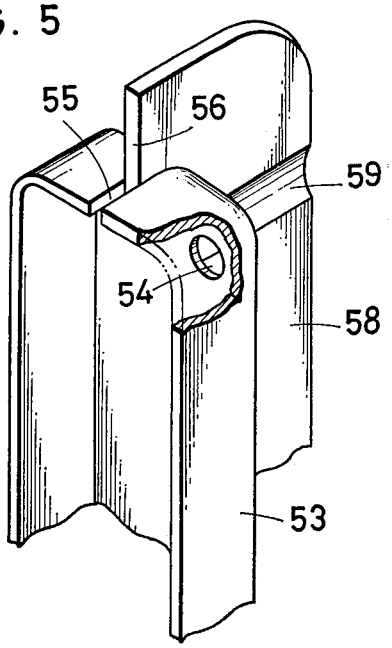
FIG. 5 is an enlarged fragmentary perspective view of a side cap of the ventilator.

As best shown in FIG. 3, a pair of side caps 52 and 53 clampingly fit over and connect the inner and outer plates 25 and 26 at their lateral sides for assembling the ventilator 10. In order to hold the caps 52 and 53 securely to the inner and outer plates 25 and 26, respectively, a number of screws (not shown) pass through openings formed in the caps, one of which openings is shown in FIG. 5 at 54, and threadedly engage the sockets 30, 51 and the hole 32 to thereby secure the caps 52 and 53 to the plates 25 and 26 to form a unified body. The upper and lower ends of the caps 52 and 53 are each provided with a slot 55 (FIG. 5) formed in the longitudinal direction of the ventilator 10. Each slot in the upper end of the caps 52 and 53 is adapted to snugly receive the mated mounting fins 29 and 43, whereas each slot in the lower end of the caps is adapted to snugly receive the mounting fin 33 of the inner plate 25. As shown in FIG. 4, the mated mounting fins 29 and 43, and the mounting fin 33 inserted in the cap slots bear at their opposite ends against the respective upper and lower lateral ends of a pair of mounting fins 57 and 58 as at 56 in FIG. 5, which fins are formed integral with and project centrally from the caps 52 and 53, respectively. A number of clearance grooves 59 of an arcuate cross-section are formed in the mounting fins 57 and 58 adjacent to the sockets 30, 51, and the hole 32 so as to facilitate the tightening and loosening of the screws above described.

When the ventilator 10 is mounted on the sash, the mated mounting fins 29 and 43, and the mounting fin 33 are inserted in the upper rail 19 and the rail 24, respectively, with respective sealing strips 60 interposed therebetween, as shown in in FIG. 2. Similarly, the mounting fins 57 and 58 are inserted in the stiles 21 and 22, respectively, with respective sealing strips 60 interposed therebetween, as illustrated in FIG. 3.

With the ventilator construction described above, wind blowing in through the opening 44 of the ventilator 10 impinges against the lower portion of the inner plate 25 opposite to the opening 44 beneath the outer plate 26 and is directed upwardly toward the L-shaped partition 36 thereby preventing the flow of high velocity air from entering directly into the building interior. Since the L-shaped partition 36 extends toward the outer plate 26 and abuts against the filter 48, the air flow is prevented from flowing between the partition 36 and the filter 48 and hence is forced through the filter 48 as indicated by the arrow 64. The air enters between the outer plate 26 and the filter 48 and again passes through the filter 48, thence through the slits 39 and the air vents 27 into the interior of the building, as shown by the arrow 65. The portion of the filter 48 below the partition 36 prevents dust carried by the wind from further entering the ventilator 10 and the portion above the partition 36 prevents any residual dust from entering into the building interior. Thus, the ventilator 10 of this invention functions to direct dust laden air twice through the filter 48, thereby substantially removing the dust completely from the air. Furthermore, any rain entering the opening 44 is effectively prevented from being admitted into the building interior even under storm condition, because the rain directly impinges upon the slanted surface of the flange 31 or against the inner plate 25 opposite the opening 44. The slanted surface of the flange 31 allows water thereon to drain out of the ventilator 10.

The ventilator 10 broadly comprises the inner plate 25 and the outer plate 26 fixedly connected by the caps 52 and 53 to form a unitary structure and hence is relatively foolproof in being mounted on the sash. Furthermore, the ventilator 10 fits in the upper and additional rail 19, 24 and the stiles 21, 22 with the sealing strips 60 peripherally mounted around the ventilator, so that any leakage of water or air past the edges of the ventilator 10 can be completely eliminated. Other additional partitions displaced from each other and abutting the filter 48 may be provided on the inner and outer plates, respectively, thereby allowing the air to pass through the filter 48 more than twice in the ventilator 10. While the ventilator 10 of this invention has been shown applied to the window assembly by way of example, it will be noted that it may be also applied to doors, walls or other building hardware.

Although a particular preferred embodiment of the invention has been disclosed in detail for illustrative purposes, it will be understood that various changes and modifications may be made without departing from the scope and spirit of the appended claims.

What is claimed is:

1. A ventilator for use as a component in a window assembly, door assembly or other building hardware, comprising:

a. an inner plate having air vent means formed therein, and having upper and lower flanges extending outwardly;

b. an outer plate engaging said upper flange of said inner plate and secured thereto, said outer plate being spaced from said inner plate in the transverse direction of the ventilator, and providing an air-intake opening vertically displaced from said air vent means;

c. a pair of side caps fitting around the vertical marginal portions of said plates and in vertically surrounding relation to said flanges;

d. a filter fixedly positioned between said plates in spaced relation to both of said plates; and e. partition means secured to one of said plates and abutting said filter for directing air flow therethrouh remotely from the partition means at least twice.

2. A ventilator according to claim 1 in which said side caps have verticlly elongated mounting fins extending laterally therefrom by which the ventilator can be mounted.

3. A ventilator according to claim 2, said upper and lower mounting flanges having horizontally elongated mounting fins extending upwardly and downwardly therefrom.

4. A ventilaor according to claim 3 including a sealing stip extending about said mounting fins and received within a vertically grooved opening of building hardware component.

5. A vnetilator for use as a component in a window assembly, door assembly or other building hardware, comprising:

a. an inner plate having air vent means formed therein;

b. an outer plate secured to said inner plate along the upper margin thereof and spaced therefrom in the transverse direction of the ventilator, and providing an air intake opening vertically below said air vent means;

c. a flange extending outwardly from said inner plate, and having an upper surface sloping downwardly to the lower edge of said air-intake opening;

d. a filter fixedly positioned between said plates in spaced relation to both of said plates; and e. partition means secured to one of said plates and abutting said filter for directing air flow therethrough remotely from the partition means at least twice.

6. A ventilator according to claim 5 in which said inner plate is imperforate between said flange and said partition means.

7. A ventilator for use with windows, doors or other building hardware, comprising:

a. an inner plate having air vent means formed therein, said inner plate having mounting fins at its upper and lower edges extending upwardly and downwardly, respectively;

b. an outer plate spaced apart a predetermined distance from said inner plate in the transverse direction of the ventilator and providing an opening displaced from said air vent means in said inner plate, said outer plate having at its upper edge an upwardly extending mounting fin which mates with the upper of said fins on said inner plate;

c. a filter fixedly positioned between said inner and outer plates; and c. a partition extending from said inner plate toward said outer plate and abutting against said filter thereby directing a flow of air at least twice through said filter.

8. A ventilator for use as a component in a window assembly, door assembly or other building hardware, comprising:

a. an inner plate having air vent means formed therein, and having upper and lower flanges extending outwardly, said upper and lower flanges having horizontally elongated mounting fins extending upwardly and downwardly therefrom by which the ventilator can be mounted;

b. an outer plate engaging and being joined to said upper flange of said inner plate, said outer plate being spaced from said inner plate in the transverse direction of the ventilator, an providing an air-intake opening vertically displaced from said air vent means;

c. a filter fixedly positioned between said plates in spaced relation to both of said plates; and d. partition means secured to one of said plates and abutting said filter for directing air flow therethrough remotely from the partition means at least twice.

9. A ventilator of the filter type for use as a component in a window assembly, door assembly or other building hardware, comprising:

a. an inner plate having air vent means formed therein;

b. an outer plate secured to said inner plate along the upper margin thereof and spaced therefrom in the transverse direction of the ventilator, and providing an air-intake opening vertically below said air vent means;

c. a filter fixedly positioned between said plates in spaced relation to both of said plates, the lower edge of said filter being above said air-intake opening; and d. partition means secured to said inner plate and abutting said filter, said plates and said partition means directing air flow upwardly first around the lower edge of said filter, thence through the filter from its inner toward its outer side, and thence from its outer toward its inner side to said air vent means.

10. A ventilator for use as a component in the window assembly, door assembly or other building hardware, comprising:

a. an inner plate having air vent means formed therein;

c. an outer plate secured to said inner plate along the upper margin thereof and spaced therefrom in the transverse direction of the ventilator, and providing an air-intake opening vertically below said air vent means;

c. mean on one of said plates defining horizontal grooves disposed between said plates above the air-intake opening;

d. a filter fixedly positioned between said plates in spaced relation to both of said plates, said filter extending between said grooves and having upper and lower margins secured therein; and e. partition means secured to one of said plates and abutting said filter for directing air flow therethrough remotely from the partition means at least twice.

* * * * *